United States Patent [19]

Fabian

[11] 4,171,748

[45] Oct. 23, 1979

[54] FOLDABLE HANGER ASSEMBLY

[76] Inventor: Samuel F. Fabian, 15 Upland Way, Haddonfield, N.J. 08033

[21] Appl. No.: 870,177

[22] Filed: Jan. 17, 1978

Related U.S. Application Data

[63] Continuation-in-part of Ser. No. 779,719, Mar. 21, 1977, abandoned.

[51] Int. Cl.[2] ..... A47B 43/00; A47F 5/08

[52] U.S. Cl. ..... 211/1.3; 211/100

[58] Field of Search ..... 211/1.3, 96, 99, 100, 211/104, 170, 171, 172, 101; 248/291, 294, 240–240.4, 166

[56] References Cited

U.S. PATENT DOCUMENTS

| | | | |
|---|---|---|---|
| 1,021,330 | 3/1912 | Price | 248/284 |
| 1,318,257 | 10/1919 | Blaustein | 211/99 |
| 1,430,755 | 10/1922 | Roberson | 211/99 |
| 1,582,762 | 4/1926 | Klock | 211/99 |
| 1,705,203 | 3/1929 | Patterson | 211/1.3 |
| 2,471,349 | 5/1949 | Reiss | 211/99 |
| 2,484,535 | 10/1949 | Stader | 211/104 X |
| 2,508,871 | 5/1950 | Stein | 211/100 |
| 2,672,241 | 3/1954 | Cohen et al. | 211/100 |
| 3,941,250 | 3/1976 | Ott | 211/100 |

FOREIGN PATENT DOCUMENTS

| | | | |
|---|---|---|---|
| 73527 | 12/1951 | Fed. Rep. of Germany | 211/100 |

*Primary Examiner*—Thomas J. Holko

*Attorney, Agent, or Firm*—Shlesinger, Arkwright, Garvey & Dinsmore

[57] ABSTRACT

A foldable hanger assembly for mounting on a wall. The assembly includes an elongated housing to which is pivotally connected a hanger arm that is stored in the housing when not in use. The hanger arm is dropped to a horizontal position for supporting clothes hanger or the like and a brace is hingedly positioned at one end on the hanger arm and the opposite end thereof is slidably engaged with the housing at a point intermediate its length.

9 Claims, 7 Drawing Figures

FOLDABLE HANGER ASSEMBLY

This application is a continuation-in-part of application Ser. No. 779,719 filed Mar. 21, 1977.

BACKGROUND OF INVENTION

Various foldable hanger devices have been developed over the years for mounting on walls in order to support clothes which are hung on clothes hangers. Such devices are illustrated in U.S. Pat. Nos. 1,705,203, 2,626,714, 2,500,881, 2,672,241 and 3,941,250.

It will be noted from a consideration of these patents that the use thereof is severely limited insofar as their ability to hold clothes hangers. It will be noted, for example, that the devices disclosed in the above patents are not capable of holding more than six hangers. This limitation is caused by the hanger arm being pivotally engaged at one end to the stationery member which is mounted on the wall and, consequently, the weight on the hanger arm must be controlled in order to avoid damage to the hanger arm.

SUMMARY OF THE INVENTION

The foldable hanger assembly of the present invention is structurally designed to accommodate a large number of clothes hangers by providing a hanger arm which is pivotally engaged with the housing at one end thereof, but wherein the hanger arm is braced intermediate its length to withstand the weight applied thereto by the hangers and articles thereon. The brace and hanger arm are foldable into the housing when the hanger arm is not in use.

The foldable assembly includes an elongated housing adapted to be mounted on a wall in vertical position. The hanger arm is pivotally connected at one end to the lower end of the housing and is foldable upwardly into a complemental channel within the housing. A brace incudes a pair of pivotally connected arms, one arm being pivotally engaged with the hanger arm and the free end of the other arm being slidably positioned in a guideway formed in the housing. One of the arms is bifurcated to provide spaced leg portions and the other arm is foldable into the space between the leg portions to facilitate folding of the hanger arm to the inoperative position within the housing.

DESCRIPTION OF THE INVENTION

Figure 1:
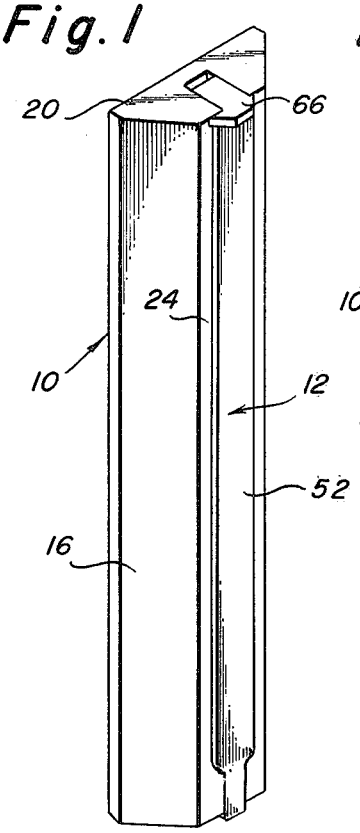
FIG. 1 is a perspective view of the foldable hanger assembly of the present invention, showing the same in inoperative position.

The hanger assembly of the present invention includes an elongated housing 10 to which is pivotally engaged a hanger arm 12 which is foldable to an inoperative position, the hanger arm being supported by a brace 14. Housing 10, hanger arm 12 and brace 14 are preferably of plastic, molded construction made of polypropylene or other suitable plastic material.

Housing 10 includes angularly disposed side walls 16 and 18, a top wall 20 and a bottom wall 22. A front wall is indicated at 24 and is provided with a longitudinal, uniform channel 26. Channel 26 is formed by a pair of spaced, opposed, parallel internal walls 28 and 30 and a rear wall 32. Rear wall 32 is substantially uniplaner with the rear of the housing and is provided with a pair of key hole slots 34 and 36 for engagement with wall mounted nails to facilitate hanging the assembly. A latch 38 extends from rear wall 32 of longitudinal channel 26, adjacent the upper limit of the assembly. Latch 38 includes a pair of spaced, semi-rigid fingers 40 and 42, the function of which will be hereinafter more fully set out.

Figure 3:
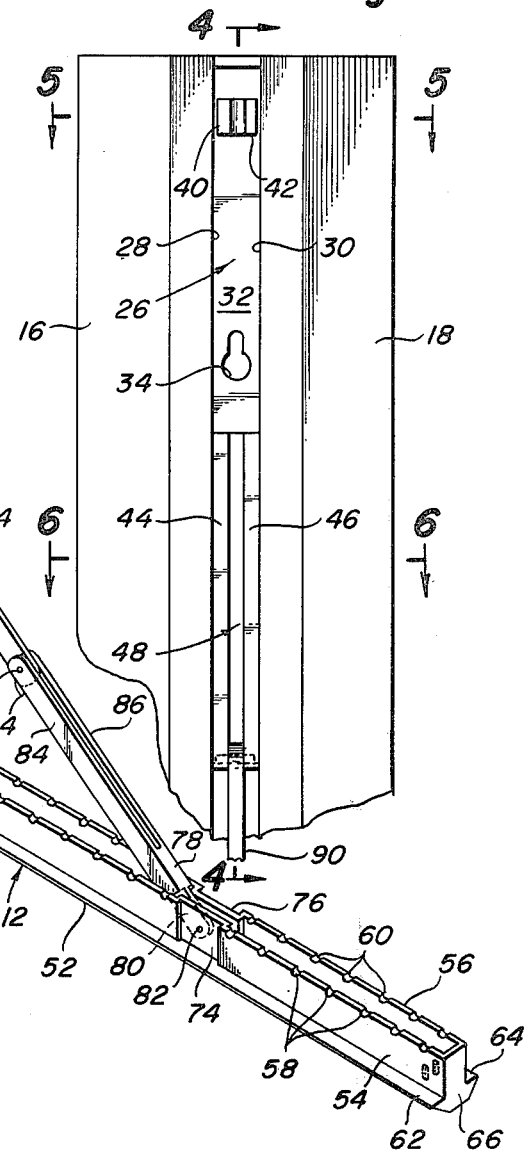
FIG. 3 is a fragmentary front elevational view of the foldable hanger assembly of the present invention, showing the same in operative position.
Figure 4:
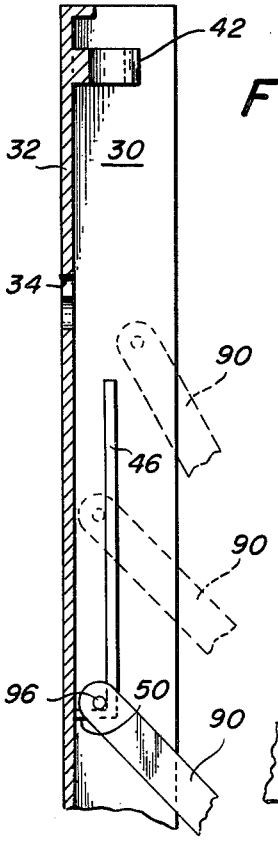
FIG. 4 is a sectional view taken along the line 4—4 of FIG. 3, looking in the direction of the arrows.

Intermediate the length of channel 26, there is provided a pair of spaced guide walls 44 and 46 extending longitudinally of the channel and spaced from rear wall 32 thereof. Spaced guide walls 44 and 46 provide a longitudinally extending guideway 48 adapted for the reception of a portion of brace 14. As seen in FIGS. 3 and 4, a stop wall 50 extends between rear wall 32 of longitudinal channel 26 and the lower end of guide walls 44 and 46 for a purpose which will be hereinafter more fully set out.

Hanger arm 12 includes an elongated body 52 from the rear face of which extend a pair of spaced, parallel walls 54 and 56 which are substantially coextensive with the length of body 50. The upper edges of walls 54 and 56 are provided with a plurality of spaced aligned notches 58 and 60 which are adapted to receive the hooks of clothes hangers. Walls 54 and 56 are spaced inwardly from the lateral edges of elongated body 50, thereby providing flanges 62 and 64 substantially coextensive with the length of body 50. An end wall is indicated at 66. Elongated body 52 is pivotally connected to housing 10 by means of a pin 68 which extends through reduced extensions 70 and 72 of walls 54 and 56, and through internal walls 28 and 30 of longitudinal channel 26. A portion of walls 54 and 56 are inset intermediate their length as indicated at 74 and 76 respectively to facilitate engagement with brace 14.

Brace 14 includes a lower arm 78, one end of which is reduced in thickness as indicated at 80 for insertion between inset portions 74 and 76 of walls 54 and 56, to which it is pivotally connected by a pin 82 which extends through the inset portions and reduced end 80.

Figure 7:
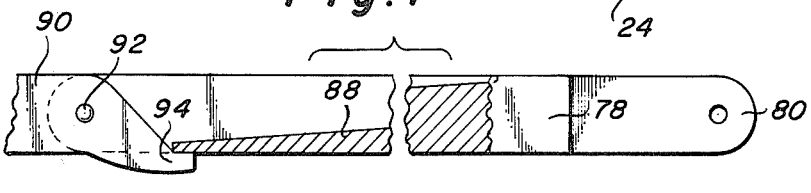
FIG. 7 is an enlarged, fragmentary sectional view of the brace forming a part of the present invention.

At a point remote from reduced end 80, arm 78 issues into spaced leg portions 84 and 86 joined by a connecting transverse portion 88. As shown in FIG. 7, the thickness of transverse portion 88 is gradually increased from one end to the other.

Brace 14 further includes an elongated flat upper arm 90, the lower end of which fits between, and is pivotally engaged with, an end of leg portions 84 and 86 by a pin 92. As further shown in FIG. 7, a portion of the lower end of upper arm 90 is extended to provide a stop member 94 which serves as an abutment for engaging transverse portion 88 of lower arm 78 when the upper and lower arm are disposed in a 180° relationship to each other. This positively precludes any greater angular relationship between the two arms.

Figure 6:
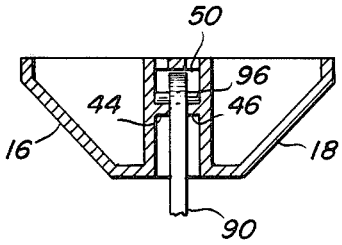
FIG. 6 is a sectional view taken along the line 6—6 of FIG. 3, looking in the direction of the arrows.
Figure 5:
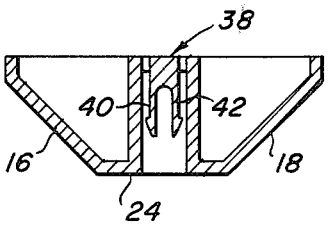
FIG. 5 is a sectional view taken along the line 5—5 of FIG. 3, looking in the direction of the arrows.

The opposite end of upper arm 90 extends through guideway 48 formed by guide walls 44 and 46, and a pin 96 extends through and beyond the lateral portions of upper arm 78 between elongated body 52 and guide walls 44 and 46, as shown to advantage in FIGS. 4 and 6. This retains the one end of brace 14 within guideway 48 but permits relative longitudinal movement thereof with respect to body 52, as indicated in dotted lines in FIG. 4, when the hanger arm is moved from the inoperative to operative position and vice versa. When it is desired to remove brace 14 from engagement with hanger arm 12, the lower part of the former is moved to the position shown in dotted lines at the upper end of FIG. 4.

In use of the assembly of the present invention, housing 10 is hung on a vertical wall by a nail, screw or other suitable means which extend through key hole slots 34 and 36 thereof. At this time, hanger arm 12 is in the raised or inoperative position and is held by the frictional engagement of fingers 40 and 42 of latch 38 with the internal faces of walls 54 and 56.

When in the inoperative position, the upper arm 90 of brace 14 is adjacent rear wall 32 of longitudinal channel 26, the arm being positioned between leg portions 84 and 86 of lower arm 78 against inclined transverse portion 88, both of which arms are in turn nested between support walls 54 and 56 of hanger arm 12.

Figure 2:
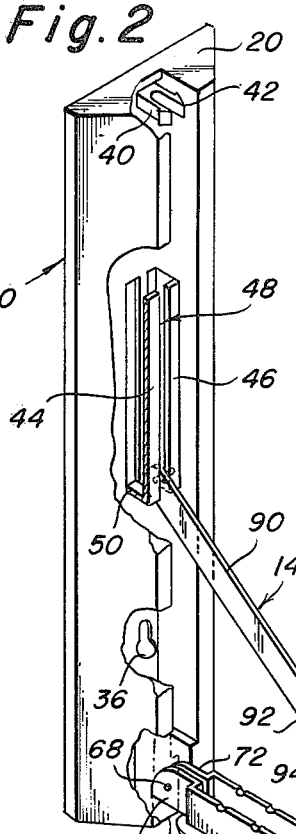
FIG. 2 is a view similar to FIG. 1 showing the assembly in operative position, portions thereof being broken away to disclose details of construction.

When it is desired to use the hanger assembly, hanger arm 12 is pulled from the top thereof proximate wall 66 to overcome the frictional engagement of latch 38 therewith, and the hanger arm is allowed to gravitate downwardly to the operative position shown in FIG. 2. As the hanger arm gravitates downwardly, the upper end of arm 90 moves downwardly in guideway 48 between walls 44 and 46 until pin 96 engages stop wall 50, at which time the hanger arm is in substantially right angular relation to housing 10.

It will be noted that, by virtue of providing a brace for the hanger arm, the strength of the latter is increased so that several times the number of garments may be accommodated thereon as with comparable foldable hanger assemblies which have been employed in the past. Additionally, even though a brace is employed, the structural arrangement of the component parts is such that there is interfitting engagement of the portions of the brace, the hanger arm and the housing to permit complete folding into a compact size within housing 10.

The present assembly further is designed so that it may be of molded plastic construction, which minimizes the cost of manufacture and enables the assembly to be made attractively for sale at low cost.

Although the assembly of the present invention has been shown and described as including the guide walls and guideway for the brace as being engaged with the housing, it is to be understood that, if desired, the guide walls and guideway may be applied to the hanger arm and the brace pivotally engaged with the housing. However, when the assembly is made of a molded plastic construction, it is preferable from the appearance standpoint to make the assembly as above described and in accordance with the attached drawing in order to avoid openings in the hanger arm due to the incidental formation thereof in the plastic molding of the guide walls. Various other changes may be made within the scope of the appended claims.

What is claimed is:

1. A foldable hanger assembly including (a) an elongated housing for mounting on a vertical wall and having front and side walls (b) said front wall being provided with a channel having a base extending longitudinally of the housing (c) spaced, opposed guide walls extending within, and longitudinally of, the housing channel, and in spaced relation to the base of the channel, whereby a guideway is formed between the opposed guide walls (d) a hanger arm comprising an elongated body disposed within the housing channel when in the inoperative position (e) one end of said hanger arm being pivotally engaged with said housing to permit the hanger arm to be removed from the housing channel and lowered to a substantially horizontal, operative position (f) a pair of opposed, spaced walls extending longitudinally of said hanger arm (g) means on the longitudinal edges of said opposed, spaced walls for engagement by clothes hangers (h) a brace extending between said elongated housing and an intermediate part of said hanger arm (i) said brace including a first arm having spaced leg portions pivotally engaged at one end with said hanger arm (j) said brace further including a second arm pivotally connected at one end to the free end of said first arm, the opposite end of said second arm extending into the guideway formed by the spaced guide walls (k) said second arm being adapted to fit between the spaced leg portions of said first arm and said brace fitting between said opposed, spaced walls extending longitudinally of said hanger arm, when the assembly is in the inoperative position, and (l) stop means for limiting the longitudinal movement of said second arm of the brace in the guideway, to maintain said hanger arm in a horizontal plane when in the operative position.

2. The hanger assembly of claim 1, wherein (a) said stop means including walls extending between the lower end of said guide walls and the base of the housing channel, and (b) a pin member extending through and beyond said opposite end of said second arm of the brace and engageable with said walls extending between the guide walls and base of the housing channel, to limit the movement of said second arm in the guideway and retain the hanger arm in a substantially horizontal position for use.

3. The hanger assembly of claim 1, with the addition of (a) latch means carried by said elongated housing in frictional engagement with an end of said hanger arm, for holding the latter in inoperative position within the longitudinal channel of said elongated housing.

4. The hanger assembly of claim 1, with the addition of (a) a plurality of spaced notches on longitudinal edges of said opposed, spaced walls for engagement by clothes hangers.

5. A foldable hanger assembly including (a) an elongated housing for mounting on a vertical wall and comprising front and side walls (b) a longitudinal channel formed in said front wall by parallel spaced, opposed internal walls connected at the base of the channel by a rear wall (c) spaced, opposed guide walls extending longitudinally of the channel and spaced from said rear wall of the channel, whereby a guideway is formed between the opposed guide walls.

(d) walls between the lower end of said guide walls and the rear wall of the channel (e) a hanger arm comprising an elongated body disposed within the longitudinal channel of the housing when in the inoperative position (f) one end of said hanger arm being pivotally engaged with said housing to permit the hanger arm to be removed from the housing channel and lowered to a substantially horizontal position (g) a pair of opposed, spaced walls extending longitudinally of said hanger arm (h) a plurality of spaced notches on longitudinal edges of said opposed, spaced walls for engagement by clothes hangers (i) a brace extending between said elongated housing and an intermediate part of said hanger arm (j) said brace including a first arm having spaced leg portions pivotally engaged at one end with said hanger arm (k) said brace further including a second arm pivotally connected at one end to the free end of said first arm, the opposite end of said second arm extending into the guideway formed by the spaced guide walls (l) said second arm being adapted to fit between the spaced leg portions of said first arm, and said brace fitting between said opposed, spaced walls extending longitudinally of said hanger arm when the assembly is in the inoperative position, and (m) a pin member extending through and beyond said opposite end of said second arm of the brace and engageable with said walls between the lower end of said guide walls and the rear wall of the channel, to limit the movement of said second arm in the guideway and retain the hanger arm in a substantially horizontal position.

6. The hanger assembly of claim 5, with the addition of (a) a latch carried by said elongated housing in frictional engagement with an end of said hanger arm, for holding the latter in inoperative position within the longitudinal channel of said elongated housing.

7. The hanger assembly of claim 6, wherein (a) said latch includes a pair of spaced, semi-rigid fingers extending outwardly from the rear wall of the longitudinal channel formed in the housing.

8. The hanger assembly of claim 5, wherein (a) the leg portions of said first arm of the brace are joined by a connecting transverse portion (b) the thickness of said transverse portion gradually increasing from one end to the other to engage said first arm when the hanger arm is moved to the inoperative position.

9. The hanger assembly of claim 8, with the addition of (a) a stop member extending from the end of said second arm which is pivotally connected to said first arm (b) said stop member engaging said transverse portion of said first arm when said arms are disposed in a 180° relationship to each other.

* * * * *